US005127303A

United States Patent [19]

Tsumura et al.

[11] Patent Number: 5,127,303

[45] Date of Patent: Jul. 7, 1992

[54] KARAOKE MUSIC REPRODUCTION DEVICE

[75] Inventors: Mihoji Tsumura, Miyakojima-ku, Osaka, Japan, 534; Shinnosuke Taniguchi, Osaka, Japan

[73] Assignee: Mihoji Tsumura, Osaka, Japan

[21] Appl. No.: 605,506

[22] Filed: Oct. 30, 1990

[30] Foreign Application Priority Data

Nov. 8, 1989 [JP] Japan ..... 1-290792

[51] Int. Cl.[5] ..... G10H 7/00

[52] U.S. Cl. ..... 84/609; 84/601; 84/645; 84/644; 364/228.6; 360/32; 360/48

[58] Field of Search ..... 369/59, 275.3; 84/464 R, 645, 671, 601, 609, 602; 364/228.6, 900; 358/342; 360/32. 48

[56] References Cited

U.S. PATENT DOCUMENTS

| | | | |
|---|---|---|---|
| 4,581,584 | 4/1986 | Bendig | 364/900 |
| 4,992,886 | 2/1991 | Klappert | 358/342 |
| 4,995,026 | 2/1991 | Makabe et al. | 84/464 R |
| 5,046,004 | 9/1991 | Tsumura et al. | 84/645 |

*Primary Examiner*—William M. Shoop, Jr.
*Assistant Examiner*—Helen Kim
*Attorney, Agent, or Firm*—Brumbaugh, Graves, Donohue & Raymond

[57] ABSTRACT

The device generates an audio signal from a sound source using a MIDI signal. The music data consists of many pieces of music stored in a memory device like a database in an on-line host computer or an external magneto-optical disc. The music generation processing operations are carried out by 2 microprocessors, each assigned a different set of functions to speed up the overall processing. The receipt and transfer of data to the sound source from the sequencer is carried out in parallel. The data is subsequently output in parallel and the contents of the buffer are monitored constantly to prevent overflow malfunctions. Clock time is divided to enable the generation of trigger signals to control tempo. By variation of the timing of the trigger signals in accordance with tempo data taken from the data stream, the tempo can be varied while reducing the reproduction time processing load.

10 Claims, 7 Drawing Sheets

KARAOKE MUSIC REPRODUCTION DEVICE

BACKGROUND OF THE INVENTION

The invention relates to the improvement of a karaoke music reproduction device for the reproduction of music and lyrics by the selection of of a piece of music from a database containing a large number of pieces of music stored in binary coded form. The database can be stored either in a host computer memory unit from which data is downloaded as required via a public analog line or else a public digital line to an on-line terminal, or, in the case of an independent reproduction unit, the database can be stored on an external magneto-optical disc or similar device.

A karaoke musical reproduction device refers to an electric device which reproduces musical accompaniments for a song while at the same time displaying the lyrics of the song on a display device such as a visual display unit. The user is able to read the lyrics as they are displayed and to sing along through a microphone in time with the musical accompaniment.

Formerly, if a person, either in his own home or outside in a bar or restaurant, wished to have the pleasure of singing along to a karaoke backing while reading the lyrics of the required song from a visual display unit, then he would also need to have access to a reproduction unit and a selection of data media such as specially prerecorded tapes or video disc. Karaoke is, however, becoming extremely popular and each of the manufacturers involved in the business has at least 3,000 separate pieces of karaoke music on offer to the public. The considerable expense involved in building up a large collection and the storage space required may thus both present problems for the user. Furthermore, a user who wishes to keep abreast of all the new releases must resign himself to a very substantial monthly outlay. Users who do not currently face problems in terms of medium (prerecorded tape, video disc) storage space must also take account of the fact that such a fortunate situation will not necessarily last forever as their collections build up.

In order to meet this problem the applicants have invented a device whereby karaoke music is created in individual units (tune or piece of music), using the smallest possible amount of data, and then stored, along with other similarly created units, in a compact database. A terminal unit and a public communications line can be used to access any of the pieces of music selected from the said database. (See European Unscreened Patent No. 0372678 and U.S. Pat. application Ser. No. 07/372,029).

The fundamental concept on which the current invention is based involves the incorporation into the reproduction unit of an analog sound source or digital sound source conforming to the MIDI (Musical Instrument Digital Interface) international standard, and the configuration of data in the form of sequences of MIDI signals which are the digital signals used to drive the sound source. The selected data is then processed by the microprocessor and the MIDI signals transmitted via the sequencer to the sound source while the lyric related data transmitted via the lyric processing unit for display on the visual display unit. Thus, by using only the signals required to drive the sound as the data required for musical reproduction, it has been possible to restrict the volume of data required for the reproduction of any given piece of music.

The types of electronic musical instruments which are structured to enable the operation of a sound source conforming to the aforementioned MIDI standard by means of a keyboard, for example, commonly incorporate a mechanism to enable the reproduction of music on the basis of data stored on magnetic disc. There is no experience of time lag when reading data from a magnetic disc not only because the reading operation itself is relatively fast but also because there is no need for particularly large amounts of data in order to use a sound source as a musical instrument. However, in the case of a karaoke musical reproduction unit, the data that requires processing is a more complex mixture not only of the music data itself but also of lyric data and of music and lyric synchronization data. For this reason the use of a single main microprocessor to process all the required data raises problems in terms of the absolute capacity of microprocessor. The external memory unit which is used in conjunction with the terminal also needs to have a fairly large capacity which makes the use of the known magneto-optical disc technique seem most appropriate. Unfortunately, however, reading from a magneto-optical disc takes longer than reading from a normal magnetic disc. The process of reading data from a magneto-optical disc also requires the use of a dedicated unit for the amplification and serial-parallel conversion of the high-density bit stream emitted by the optical pick-up. Generally speaking the main microprocessor will also be programmed to correct errors in the parallel data blocks emanating from the said dedicated unit. In this case the read-out of data from the dedicated unit is given absolute priority. If, therefore, we assume for the moment that there is an overlap between the musical reproduction processing time and the time required for the loading of the dedicated unit, then the musical reproduction processing will be deferred. This will significantly increase the frequency with which musical reproduction processing is inhibited. If such inhibit periods begin to accumulate then accurate musical reproduction will eventually become impossible. If we are to exercise effective control over karaoke music reproduction time, then clearly we must find the answers to these problems.

Furthermore, for the purposes of the present invention, the applicants also envisage on-line connection of the reproduction unit to a host computer. Data would be downloaded from the host computer via a public communications line and subsequently processed by means of a known modem processing operation for input to the reproduction unit in serial data format. The terminal unit converts the said data into an "n"-bit data sequence for storage in main memory. If the data is stored in the main microprocessor in fixed quantities, then a file can be downloaded as and when required for storage on the external magneto-optical disc simply by repeating the download operation an appropriate number of times. However, if the main microprocessor is required to carry out all the above operations, then when the microprocessor is controlling the disc, the unit itself will be prevented from receiving data from the host computer. In this case download control must be exercised by programming the microprocessor to permit downloads only when the host computer has been advised by means of a handshake signal that a download operation is enabled and by inhibiting downloads at all other times. Unfortunately, a configuration of this type not only greatly prolongs the required transfer time and the costs of transfer but also limits the host computer's parallel processing capacity. If we are to exercise effective control over karaoke music reproduction time, then clearly we must find the answers to these problems.

The procedure adopted for the reproduction of music by driving a sound source conforming to the MIDI standard, is first to process data serially in a sequencer and then to transmit the processed data to the sound source. In terms of the control operations involved, "n" bits of music data must first be output in parallel from the main microprocessor and stored in the sequencer buffer. A start bit and a stop must then be added to the "n" data bits in the buffer and the processed "n+2" data bits transmitted serially via the I/O port to the sound source. The serial data is then analyzed by the microprocessor incorporated into the sound source in order to generate analog audio signals which are subsequently output from the sound source to an amplifier. This type of control, however, necessitates the conversion to a serial data format of the "n" musical data bits output in parallel from the microprocessor to the sequencer output buffer, which makes the required processing time considerably longer than would be the case if the data could be left in a parallel format for retransmission from the sequencer buffer. Furthermore, while data is being output serially to the sound source, receipt of the next musical data frame from the main microprocessor by the sequencer output buffer is inhibited. In other words, the wait time required for data input in parallel to the sequencer is dictated by the length of time taken for the serial output of data from the sequencer. Furthermore, a start bit and a stop bit must also be added to mark the beginning and end of an input data frame consisting of "n" data bits thereby increasing the length of the output data frame to "N+2" musical data bits. This increases the difference between input and output time yet further and in so doing creates a substantial obstacle to the achievement of precise time control which is one of the principal prerequisites for the successful performance of music. An additional problem is that even if a situation occurs wherein the sound source is still in course of processing data internally and is not yet able to receive the next data frame from the sequencer, there is no signal line defined for the purpose of advising the sequencer to suspend transmission of the next input frame to the sound source until such time as it has completed its current processing operation. The sound source is thus unable to control the operations of other peripheral units with the result that the data overflows and the reproduction becomes defective. If we are to exercise effective control over reproduction time, then clearly we must also find the answers to these problems.

The successful reproduction of a piece of music through the medium of a sound source requires not only the accurate reproduction of the volume, tone and power of the piece but also a faithful representation of the tempo of the music. In the case of a piece of music with a constant tempo, the tempo related information need only be input once at the start of reproduction. However, the effectiveness of a musical performance can be greatly enhanced by the inclusion of variations played at different tempos, for example, or by the incorporation of a gradual slowing of tempo (ritardando) towards the end of the piece, and these effects must be accurately reflected in the reproduction. The time control and processing of the corresponding stream of binary coded data bits naturally requires special configuration. If, however, the amount of data relating to a given piece of music is ambitiously augmented for the sake of enhancing the musicality of the reproduction, then this will effectively reduce the capacity of the main microprocessor to handle other processing operations, and is thus a situation which must be avoided. A method is, therefore, called for which will enable enhancement of the musicality of a reproduction while at the same time keeping any increase in the amount of required data within acceptable limits.

The way in which a network is configured around a host computer and digitally coded music signals are transmitted to a number of terminal units, which falls into the same sort of technical field as the present invention, is already known insofar as it involves no more than the use of digital music signals in a computer network. A typical system of this type might, for example, be configured in such a way that digital signals could be transmitted from a host computer database to a personal computer, which would function as the terminal unit. A programmable sound generator IC incorporated into the said terminal unit would then analyze the music for reproduction in accordance with the language recorded on the IC. The type of IC used here can be produced quite cheaply which means that the cost of the terminal unit can also be kept down. On the other hand, however, this type of IC has only limited capacity and is not capable of sophisticated multiple sound level control. In these respects, therefore, the way in which this IC solves the problems posed above differs from the technical solutions proposed by the applicants in respect of the present invention.

OBJECTS OF THE INVENTION

It is a general object of the invention to affect improvements to the above invention, insofar as it impinges on the applicants' invention, in order to produce a unit with higher user value. It is a more specific object of the invention to place the functions related to the reading of data from the magneto-optical disc and the functions related to the reproduction of the music under the control of two individual dedicated microprocessors, and in this way to provide a mechanism for the accurate control of timing in the reproduction of karaoke music.

It is another object of the invention to use one of the two microprocessors incorporated into the reproduction unit specifically to store data transferred via the public communications line in memory, thereby reducing transmission time and enabling more effective control to be exercised over the timing of the reproduction of karaoke music.

It is still another object of the invention to enable precise control of the timing of music reproduction by linking the sound source and the sequencer in such a way that data transmitted in parallel from the microprocessor to the sequencer can also be output in parallel from the sequencer to the sound source, while at the same time preventing the overflow of data at the sound source and the consequent defective reproduction of the music.

It is a further object of the invention to provice a mechanism for the accurate reproduction of variation in the tempo of karaoke music by the addition of a quantity of data which is both relatively small by comparison with the overall quantity of music data and which can be used as indentification data to avoid processing delays.

"Music data" is the term used in this specification to refer to binary coded data which includes musical composition and performance data, lyric data and also file data. "Composition data" is the term used to refer to that part of the said binary coded music data which relates specifically to the composition and performance of the music and "lyric data" is the term used to refer to that part of the said binary coded music data which relates specifically to the lyrics.

The objects of the invention outlined above plus other objects, features and merits not outlined above may be clarified by reference to the following detailed explanations and drawings.

BRIEF DESCRIPTION OF DRAWINGS

The accompanying drawings illustrate the preferred embodiments of the invention wherein.

DESCRIPTION OF THE PREFERRED EMBODIMENTS

There follows a description of the preferred embodiments of the invention by reference to the accompanying drawings.

Figure 1:
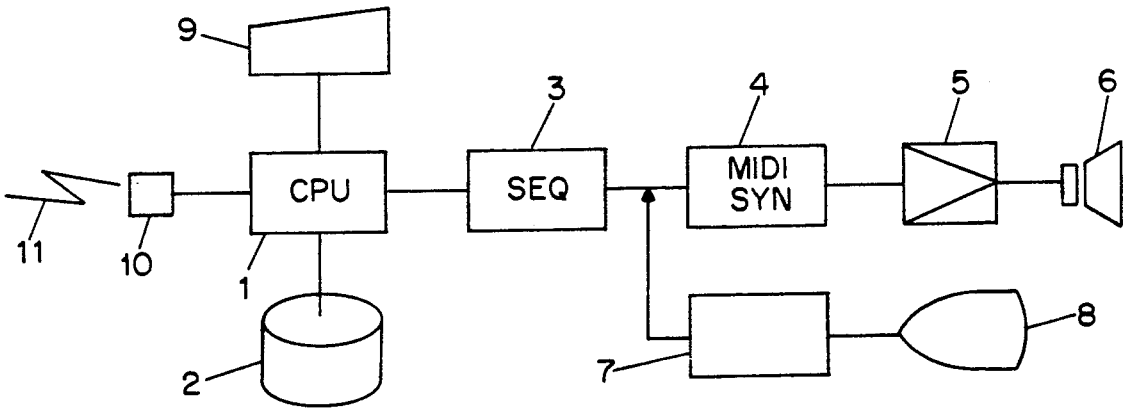
FIG. 1 is a schematic block diagram of an entire karaoke device using the invention.

FIG. 1 is a schematic representation of a karaoke music reproduction device using the invention. The basic concept of the device involves on-line connection to a host computer which holds a music database from which required music data can be downloaded and used as the basis for the generation of audio signals and for the display of lyrics on a visual diaplay unit. The applicants have assembled the present karaoke music reproduction device in the form of an on-line terminal unit. The main microprocessor 1 controls the entire karaoke music reproduction device and processes downloaded data. The external memory unit 2 in the present embodiment is a magneto-optical disc. The sequencer 3 carries out serial processing of data processed by microprocessor 1 and divides the said data into music data and lyric data for onward transmission to the next appropriate block. The sound source 4 is an analog sound source or digital sound source which conforms to the MIDI standard. An amplifier 5 amplifies the audio signal generated by the sound source 4. 6 is a speaker. Lyric data is output from the sequencer 3 to a lyric processing unit 7 which analyses the lyric data and then transmits it onward to a display device such as a visual display unit 8. An input device 9 such as a keyboard is used to request download of required music data, for example, or to read data from the magneto-optical disc 2. 10 is a modem and 11 is a public communications line. Not shown in the diagram is a host computer which is connected to the other end of the public communications line and which constitutes a database containing a large store of music data.

Figure 2:
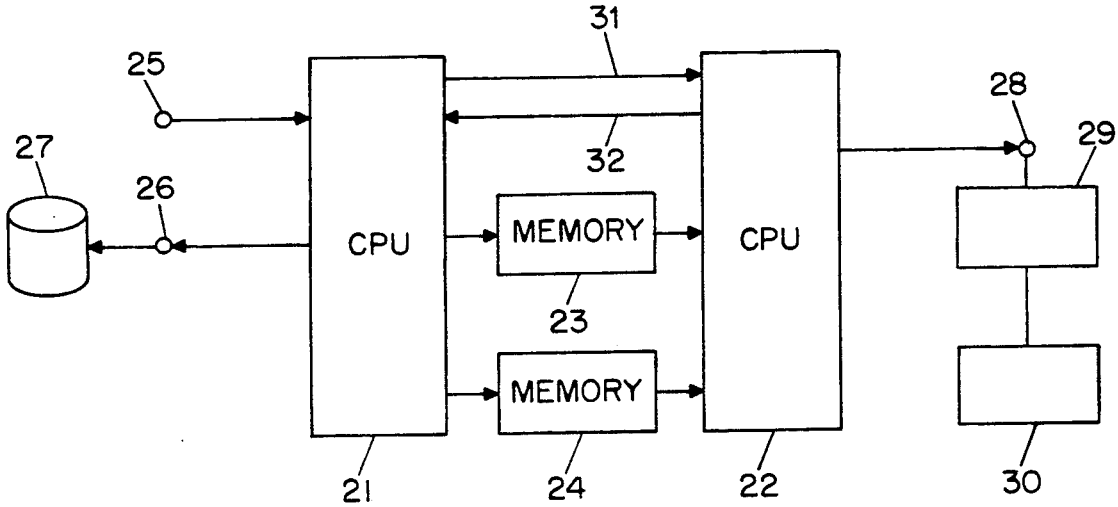
FIG. 2 is a block diagram of that part of the inventon which contributes to the precise control of the timing of a music reproduction by enabling the assignment of separate functions to 2 microprocessors.

FIG. 2 illustrates the basic configuration of the main microprocessor 1 in FIG. 1. This configuration represents one possible embodiment of the invention for the precise control of the timing of musical reproduction by assigning exclusive functions to each of 2 microprocessors in order to ensure that each microprocessor has ample spare processing capacity. The writing of music data from the external magneto-optical disc to memory is a function assigned exclusively to microprocessor 21, while the reading of music data from the memory and the conversion of the said data to signals based on the MIDI standard are functions assigned exclusively to microprocessor 22. Memory 23 and memory 24 are each music data storage areas. Although it is not essential that both memory 23 and memory 24 each use independent semiconductor memories, it is nevertheless a precondition of the invention that the memory area should be capable of configuration into equal parts. 25 is a data input terminal, 26 the magneto-optical disc drive control signal terminal, 27 the magneto-optical disc and 28 the terminal which outputs MIDI signals to the sound source, which conforms to the MIDI standard, and which in this way controls the sound source 30 via the sequencer 29. Data flows in one direction only from microprocessor 21 through memory 23 or memory 24 to microprocessor 22. The operations of microprocessor 21 and microprocessor 22 are timed by means of a stand-by signal 31 and a set signal 32 which serve to ensure alternate operation by each of the microprocessors regardless of whether the next operation is a read or a write operation either to or from memory 23 or memory 24.

Figure 3:
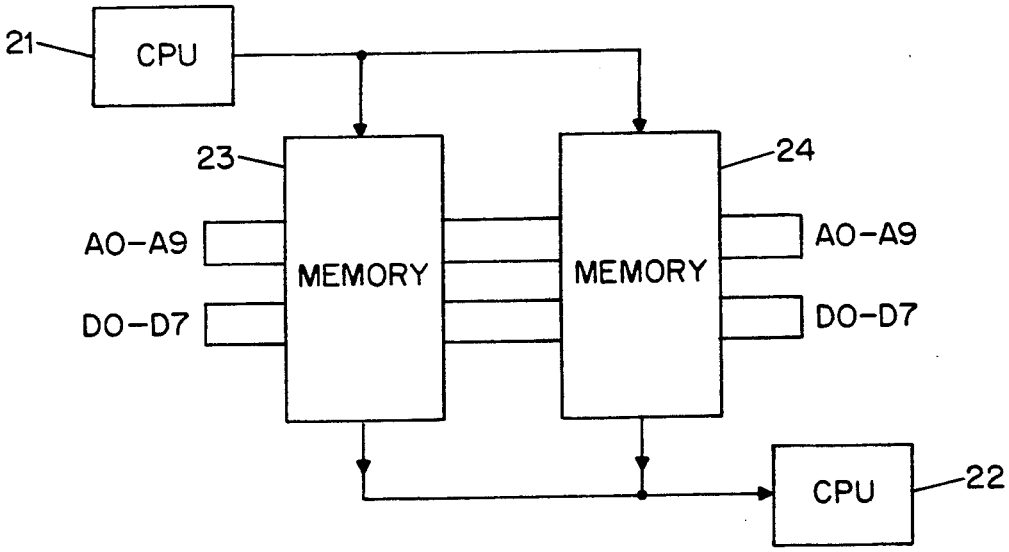
FIG. 3 is a block diagram of the memory concept.

FIG. 3 is a block diagram illustrating the flow of data through memories 23 and 24 as contained in FIG. 2. Microprocessor 21 writes data into the specified memory address in either memory 23 or memory 24, whichever has already been processed. Microprocessor 22 reads data out of whichever memory it has been written to and processes it. $A_0$ $A_9$ are empty addresses in both memory 23 and memory 24. $D_0$ to $D_9$ are areas holding data.

Figure 4:
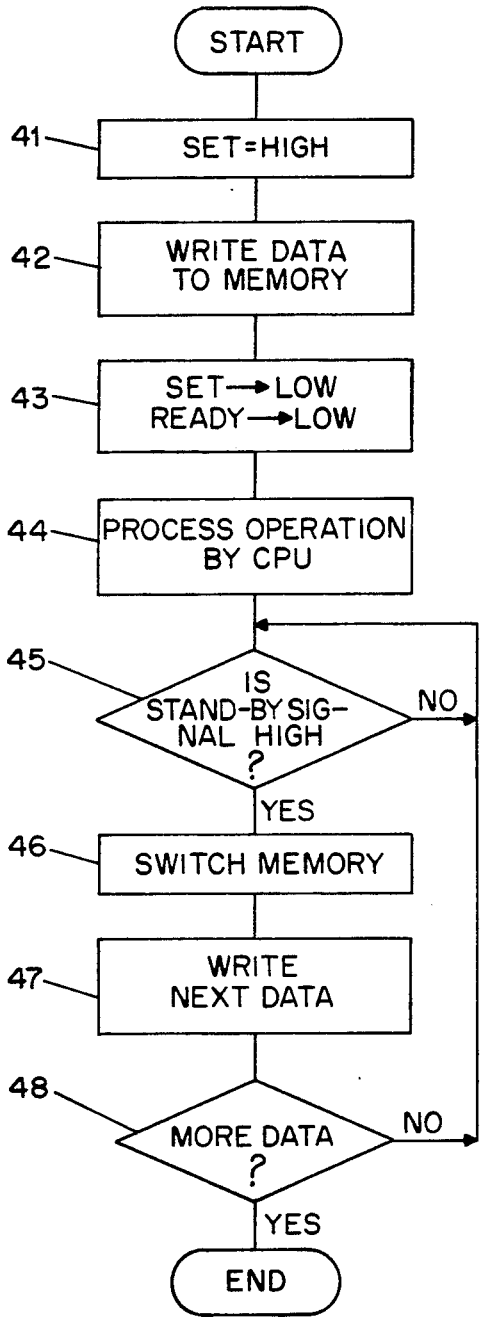
FIG. 4 is a flowchart of the functions of one of the microprocessors in FIG. 2.
Figure 5:
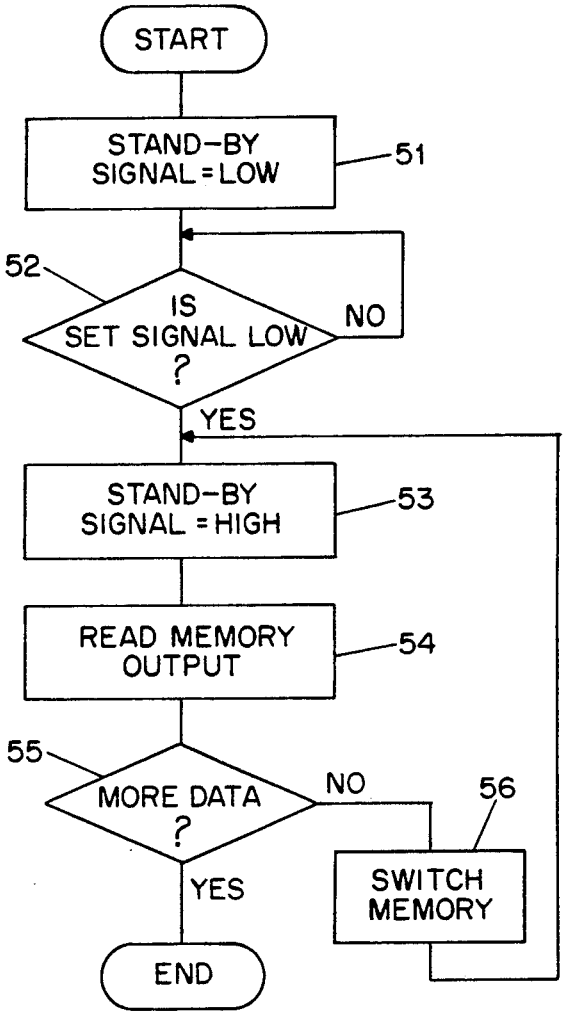
FIG. 5 is a flowchart of the functions of the other microprocessor in FIG. 2.

FIG. 4 is a flowchart illustrating the order of steps in microprocessor 21 in FIG. 3, starting from a point where there is no data written either to memory 23 or to memory 24. While this status lasts it is impossible for microprocessor 22 to read data from either memory and so, in order to prevent a processing error, microprocessor 21 sets the set signal 32, which is output from microprocessor 21 to microprocessor 22, to high (41). Microprocessor 21 then writes data to both memory 23 and memory 24 (42). On completion of the write operation microprocessor 21 resets the set signal 32 to low (43). The low status of the set signal will now be maintained for as long as there is data written to either of the memories. FIG. 5 illustrates the operations carried out by microprocessor 22. When the set signal 32 falls to low, microprocessor 22 first sets the stand-by signal 31 to high and reads the contents of memory 23 and then subjects the data which it has read out to the next processing operation (44). When microprocessor 22 relinquishes control of memory 23, it sets the stand-by signal 31 to high. Microprocessor 22 also monitors the rise of the stand-by signal (45) and when it judges it to be high then it switches the memory processing area to memory 24 (46). Microprocessor 21 then writes the next data to memory 23 which is now empty again (47). These alternating operations continue until all the data relating to a given piece of music has been processed (48).

The processing procedure of microprocessor 22, as illustrated by FIG. 5, has already been partially explained in connection with FIGS. 2 and 3. When the stand-by signal 31 is low (51), microprocessor 22 also monitors the status of the set signal 32 (43) and when it detects a fall (52), it sets the stand-by signal 31 to high (53) while at the same time reading the data held in one of the memories, converting it to MIDI signals in accordance with the program and then outputting it again (54). Microprocessor 22 then decides whether or not there is more data to follow (55) and, in cases where it determines that there is still data held in the memory, it switches to the other memory area (56), sets the stand-by signal 31 to high (53) and reads the data out of the other memory. This sequence of operations continues until all the data has been processed.

Figure 6:
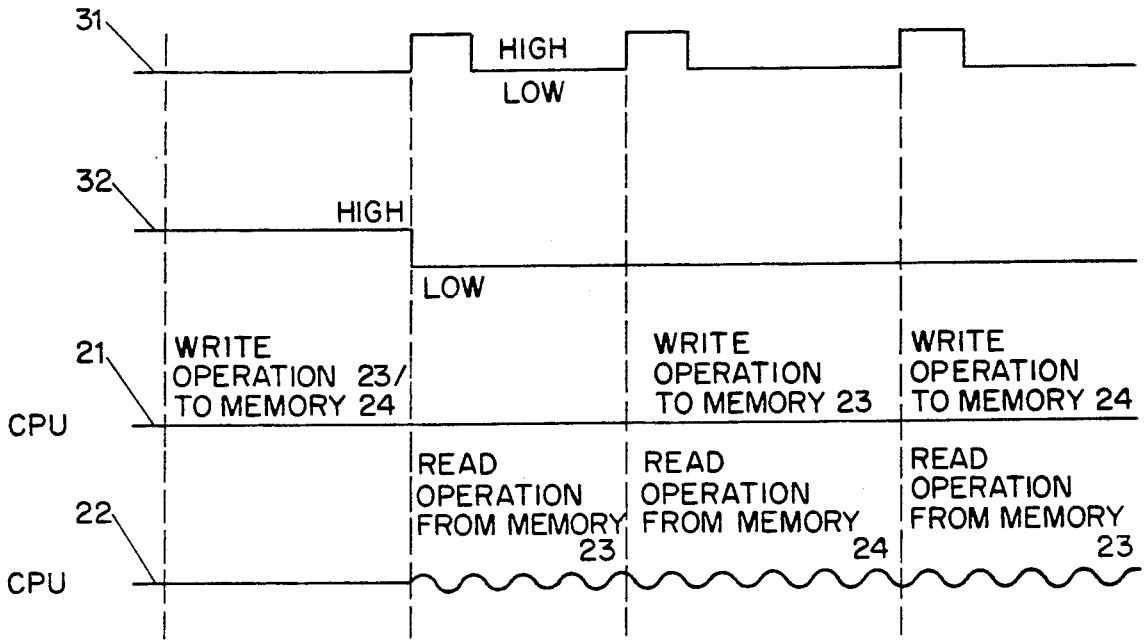
FIG. 6 is a timing chart of the interaction of the 2 microprocessors in FIG. 2.

FIG. 6 is a timing chart while illustrating the timing relationship between the stand-by signal 31, the set signal 32 and the operations of microprocessor 21 and microprocessor 22. It will be clear from the figure that the write operation to memory 23 and the read operation from memory 24 are being carried out simultaneously, and that microprocessor 21 and microprocessor 22 are, therefore, continuously engaged in processing operations in respect of one or other of the two memories. High speed processing is thus possible, since both microprocessors have the capacity to function as independent, dedicated units. The use of timing signals to control the read and write operations of microprocessor 21 and microprocessor 22 in respect of memory 23 and memory 24 by switching alternately between the two thus enables more efficient conversion of data.

Figure 7:
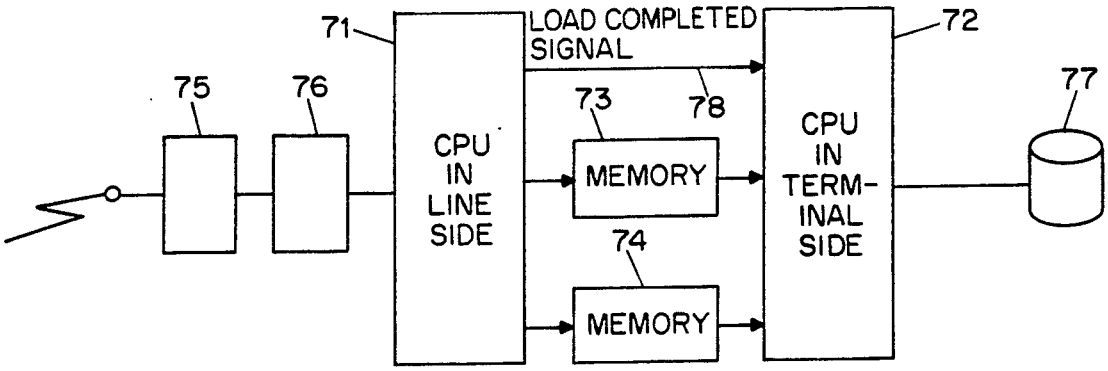
FIG. 7 is a block diagram of an alternative embodiment to that illustrated in FIG. 2 of that part of the invention which contributes to the precise control of the timing of a music reproduction by enabling the assignment of separate functions to 2 microprocessors.

FIG. 7 illustrates an alternative embodiment of that part of the invention which contributes to the precise control of the timing of a musical reproduction by assigning separate functions to the two different microprocessors which together constitute the main microprocessor. In this case microprocessor 71 and microprocessor 72 are making common use of memory 73 and memory 74 for the sequential storage of each unit of data in memory. Data unit capacity depends on the storage capacity of the memory. Data transmitted via a public analog or digital line is checked for errors by a modem 75, thereby ensuring that the flow of binary data is error free. The serial data stream is then converted into an appropriate format for parallel processing by a serial-parallel conversion circuit 76. Microprocessor 72 also has a magneto-optical disc unit 77 connected to it. Although, in common with the previous embodiment, it is not essential that both memory 73 and memory 74 each use independent semiconductor memories, it is nevertheless a precondition of the invention that the memory area should be capable of configuration into equal parts. Another feature that the present embodiment shares with the previous one is that data flows in one direction only from microprocessor 71 through memory 73 or memory 74 to microprocessor 72.

Write operations in respect of both memory 73 and memory 74 are thus controlled by microprocessor 71, while read operations in respect of both memories are controlled by microprocessor 72. In order to prevent simultaneous download and save operations from being carried out in respect of the same memory, a "memory load completed" signal 78 is output from microprocessor 71 to microprocessor 72. This signal advises microprocessor 72 that microprocessor 71 has downloaded data either to memory 73 or to memory 74. 79 is an ordinary public communications line.

Figure 8:
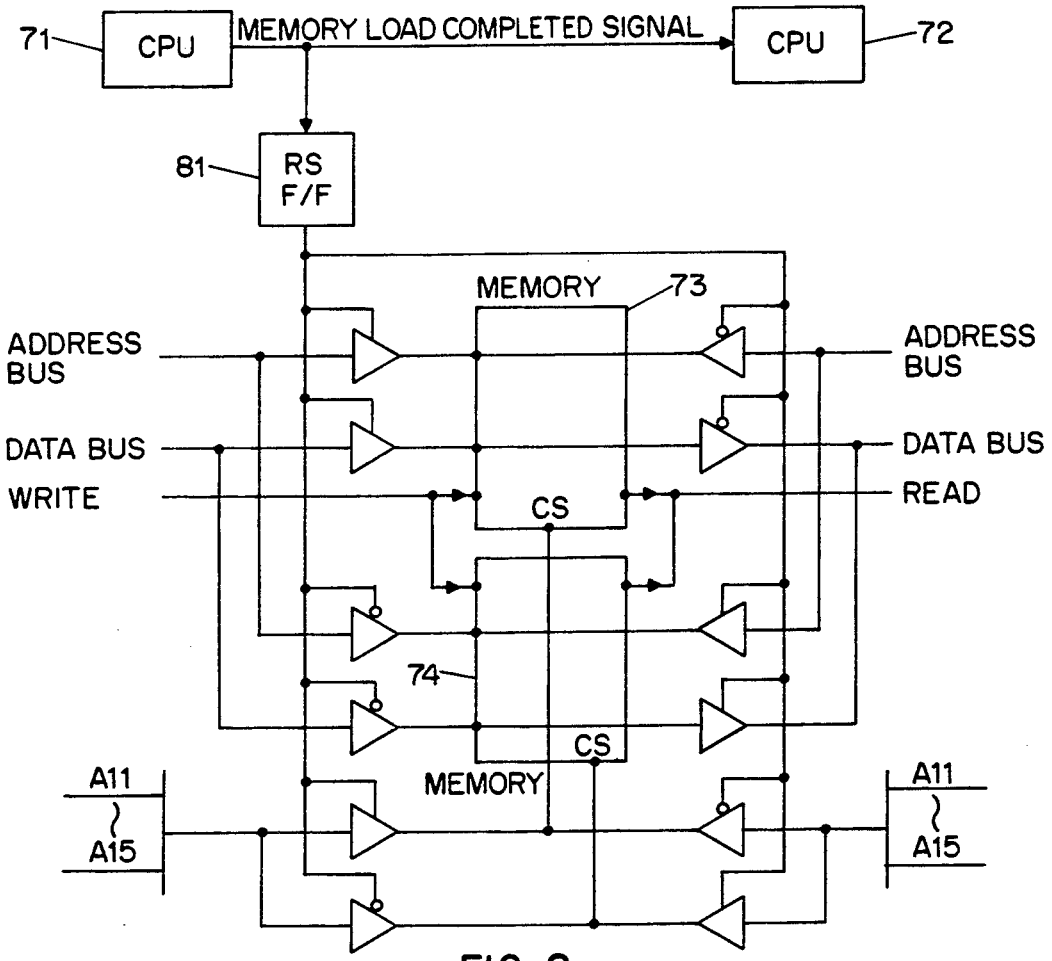
FIG. 8 is a block diagram of the concept of the memory area shown in the configuration in FIG. 7.

FIG. 8 is a block diagram illustrating the flow of data between memory 73 and memory 74 as shown in FIG. 7. Microprocessor 71 writes data into the specified memory address in either memory 73 or memory 74, whichever has already been processed and is currently empty. Microprocessor 72 reads data out of whichever memory it has been written to and saves it to magneto-optical disc 77. As shown in the diagram, this is accomplished by the transmission of a high "memory load completed" pulse from microprocessor 71 to RS flip-flop 81, the output of which selectively assigns read and write operations to memory 73 and memory 74 through the medium of 3-statement buffers which stand in inverse relationship to each other. The chip select CS similarly selects the memory area for the subsequent processing operation by switching its selections alternately in response to the output from RS flip-flop 81. Furthermore, if the memory addresses of memory 73 and memory 74 are independent of the addresses of the main memory of microprocessor 71 and microprocessor 72, then there is no need to limit their location. Thus, it this circuit, addresses A11 to A15 are used, assigned to the upper addresses of each memory.

Figure 9:
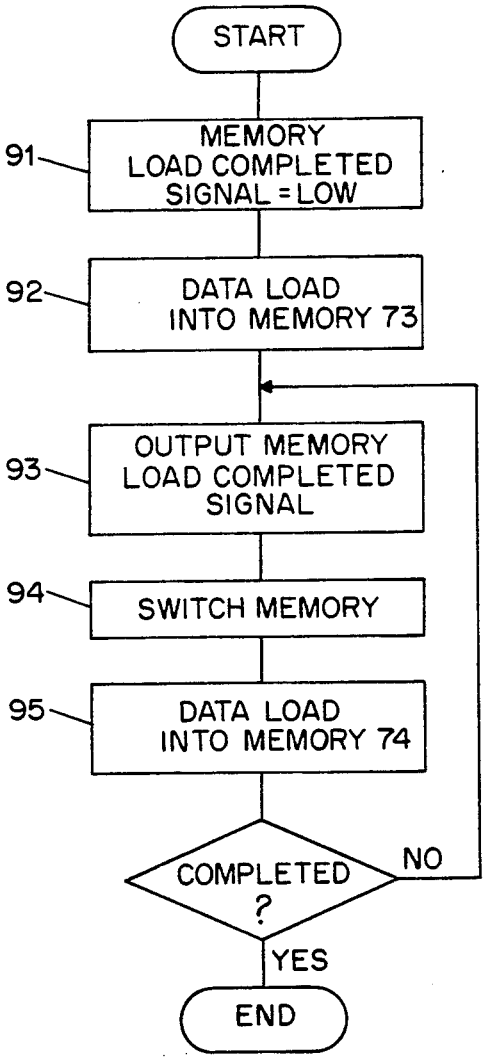
FIG. 9 is a flowchart of the functions of one of the microprocessors in FIG. 7.

FIG. 9 is a flowchart illustrating the data processing operations of microprocessor 71 as shown in FIGS. 7 and 8.

Figure 10:
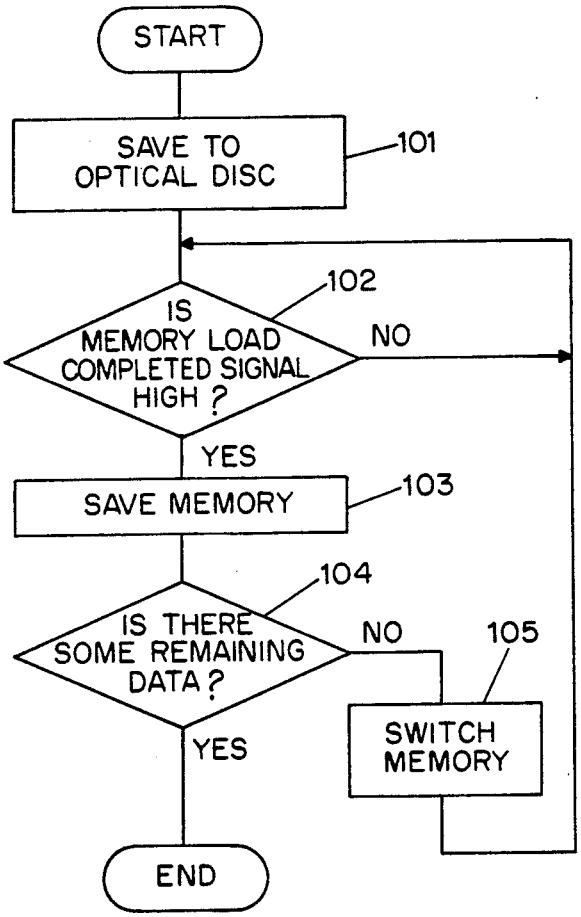
FIG. 10 is a flowchart of the functions of the other microprocessors in FIG. 7.

FIG. 10 is a flowchart illustrating the saving of data to the magneto-optical disc 77 by microprocessor 72 as shown in FIG. 10. Both flowcharts take a situation where there is no data written to either memory 73 or to memory 74 as their common start point. At the start point, therefore, the "memory load completed" signal 78 is low (91) If data is transmitted from the host computer to microprocessor 71 while it is in this state, then the first unit of data will be loaded into memory 73 (92). When this operation has been completed the "memory load completed" signal pulse from microprocessor 71 to microprocessor 72 is set to high (93). When microprocessor 71 detects a rise in this signal, then is changes the memory which it is using by switching the chip select CS (94) and then loads the next unit of data into memory 74 (95). At the same time, microprocessor 72 selects memory 73 and reads the stored data which it then saves to the magneto-optical disc 77 (101). In order to avoid the sorts of errors which would result from writing the next unit of data into memory 73 before the previous unit has been read, the microprocessors monitor the status of the "memory load completed" signal and save whenever it is set to high (102, 103). For this reason, it is essential that the "memory load completed" signal should be set to high for longer than the time required to save a single unit of data. If there is still some data remaining in memory (104), then the microprocessor 72 switches memory (105) and carries out the next save operation. By repeating the above sequence of operations until all the data relating to a particular piece of music has been loaded and subsequently saved, it is possible to download all the data to the magneto-optical disc 77 without interruption. Immediately prior to the start of a download operation the quantity of data relating to the piece of music to be downloaded is defined as the block size of the file and this information is recorded in the microprocessor 71 memory. As each unit of data is subsequently downloaded the block size of the file is also reduced by an equivalent amount. In this way the microprocessor is able to determine that all the data has been processed when the block size is reduced to 0.

Figure 11:
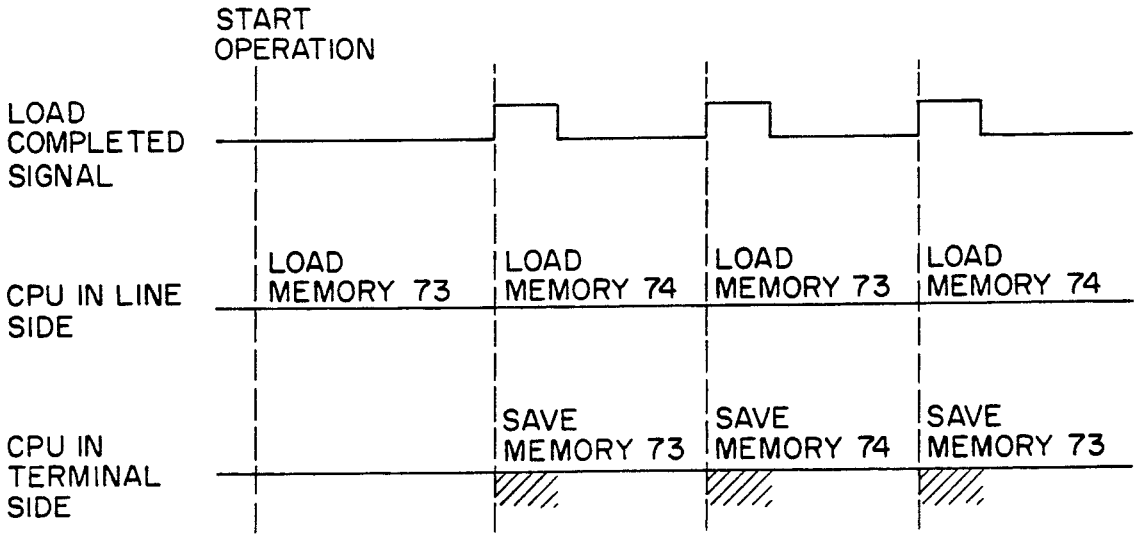
FIG. 11 is a timing chart of the interaction of the 2 microprocessors in FIG. 7.

FIG. 11 illustrates the relationship between the timing of the operations of microprocessor 71 and microprocessor 72 and the output of the download completion signal as shown in FIGS. 7 and 8. It will be clear from the figure that the write operation to memory 73 and the read operation from memory 74 are being carried out simultaneously, and that microprocessor 71 and microprocessor 72 are, therefore, continuously engaged in processing operations in respect of one or other of the two memories. High speed downloading is thus possible, since both microprocessors have the capacity to function as independent, dedicated units.

Figure 12:
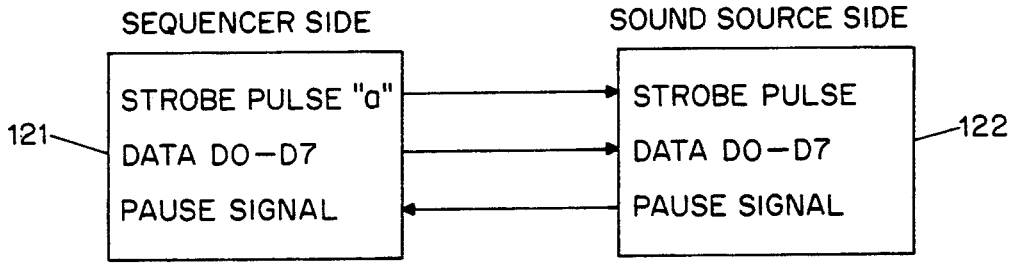
FIG. 12 is a block diagram of an embodiment of the connections between the sequencer and the sound source which are required for the reproduction of tempo variations by means of precise timing control.

FIGS. 12 to 15 illustrate the control mechanism used to ensure that music reproduction is not subject to the problem of data overflow at the sound source, for example, as a result of the receipt of commands from both the sequencer 3 and the sound source 4 as contained in FIG. 1. FIG. 12 shows the data connections between the sequencer 121 and the sound source 122, which are designed to enable the parallel transfer to sound source 122 of "n" bits of music data $D_0$ to $D_{(n-l)}$, which have been processed by the sequencer microprocessor and which are being held temporarily in the sequencer 121 transmit buffer. This part of the device is configured in such a way as to enable the output of a sampling strobe pulse "a" from the sequencer 121 to the sound source 122, and for the sequencer 121 to monitor a pause signal "b" output by the sound source 122.

Figure 13:
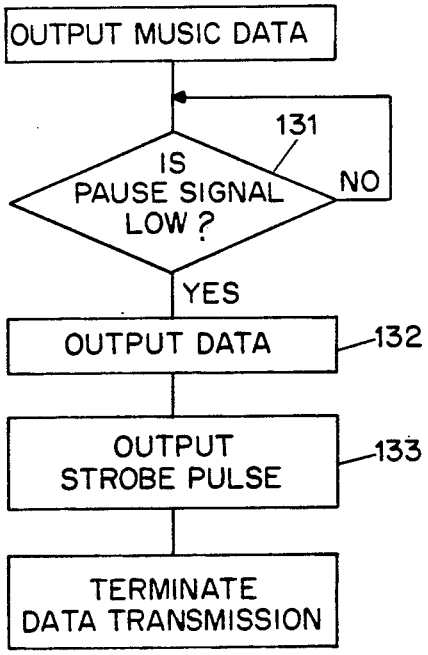
FIG. 13 is a flowchart of the output operation of the sequencer in FIG. 12.

FIG. 13 is a flowchart, illustrating the output operation of sequencer 121. Before outputting music data, the sequencer 121 first checks to see if a pause signal has been output from the sound source 122 (131). If the pause signal is high (prompting a NO response in the flowchart), this indicates that the sound source is not yet ready to receive data and the sequencer will remain in stand-by mode, repeating the same determination loop until such time as the sound source is prepared to accep the data. If, on the other hand, the pause signal is low (indicating that a pause signal is not being output and prompting a YES response in terms of the flowchart), this indicates that the sound source is prepared to receive data and the data is output to the sound source accordingly (132). A strobe pule "a" is then output (133) and data transmission terminated.

Figure 14:
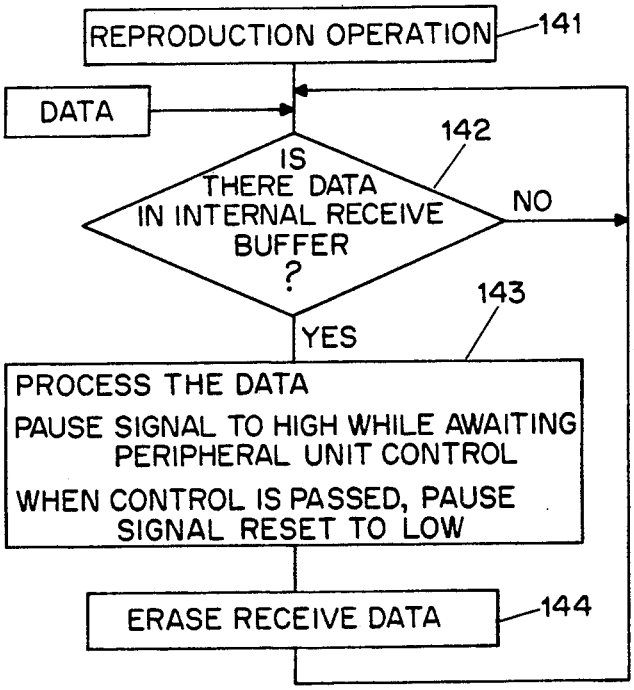
FIG. 14 is a flowchart of the sound source reproduction processing operation.

FIG. 14 is a flowchart illustrating the normal reproduction processing operations of the sound source 122 in FIG. 12. At the start of reproduction operations (141) the sound source 122 first checks its internal receive buffer to see if it is holding any music data from the sequencer (142). If so (YES on the flowchart) then it processes the data (143). If the sound source microprocessor is awaiting control of a peripheral unit, then the sound source will set the pause signal to high to indicate that it is not yet ready to receive more data from the sequencer. When control of the peripheral unit is passed to the sound source microprocessor, the sound source resets the pause signal to low and the microprocessor processes the receive data which it then outputs to the peripheral unit. Receive data is thus erased on completion of processing (144), thereby leaving the internal receive buffer free to accept the next unit of data.

Figure 15:
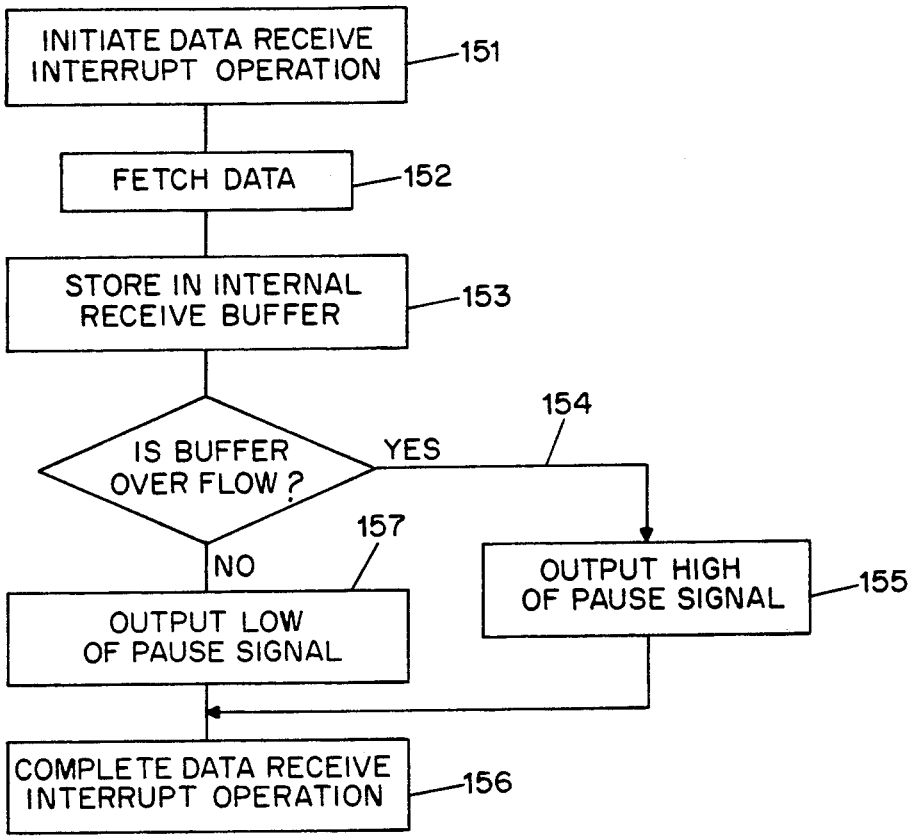
FIG. 15 is a flowchart of the sound source data receive interrupt operation.

FIG. 15 illustrates a data receive interrupt in the case of data received by the sound source 122 from the sequencer 121 as shown in FIG. 12. In this case the sound source receives strobe pulse "a" from the sequencer and initiates the data receive interrupt operation (151). The subsequent receive or, to be more precise, the subsequent data fetch operation (152) must be assigned priority over all other internal processing operations. The data which is received is stored temporarily in the internal receive buffer (internal memory) (153) and is processed sequentially as shown in FIG. 14. If for any reason the data stored in the internal receive buffer is not processed, then the memory will remain full and the input of further data would cause the internal receive buffer to overflow (154) (YES in the flowchart). If the sound source detects such a situation then it immediately sets the pause signal to high (155) to indicate that it is not yet prepared to receive more data, thereby delaying transmission from the sequencer and enabling it to complete the current receive interrupt processing operation (156). If, on the other hand, there is enough space in the internal receive buffer to accommodate the next data frame without overflow (NO in the flowchart), then the sound source sets the pause signal to low (157) to indicate to the sequencer that it is prepared to receive more data and then completes the current receive interrupt processing operation in the same way as outlined above (156).

Figure 16:
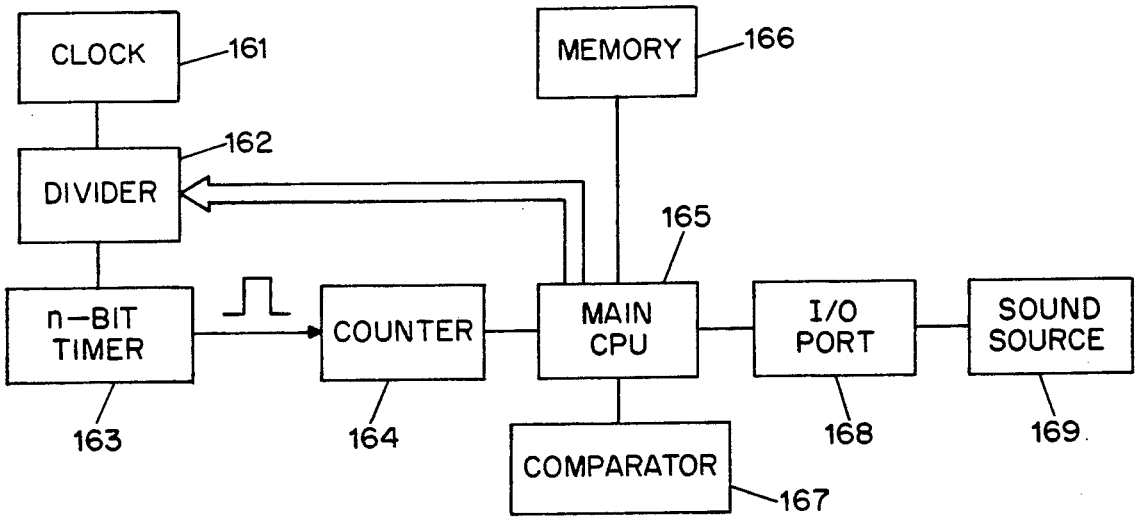
FIG. 16 is a block diagram of an embodiment of the sequencer time control mechanism.

FIG. 16 illustrates the configuration required to ensure an effective determination and variation of the tempo of a musical reproduction without generating any ill effects in terms of the overall time control of the data processing operation. In order to simplify the basic explanation we have assumed the use of just one microprocessor corresponding to the microprocessor which controls the operation of the sound source as outlined above. The clock 161 on which the time processing operations are based can be either an internal or external clock, although in practice the microprocessor's internal clock is normally used in order to facilitate the matching of the time related processing operations to the timing of the microprocessor's other processing operations. 162 is a divider which generates the specified division values in accordance with the clock 161.

The division values are configured in such a way that they can be modified by means of a signal from the microprocessor. 163 is an "n"-bit timer which generates trigger signals in accordance with the division values generated by the divider 162. Taking account of the degree of precision of the music data and the capacity of the microprocessor, we have made the timer in this embodiment a 16-bit timer. 164 is a counter which advances the count value in accordance with the trigger signals it receives. 165 is the main microprocessor which carries out the central control of each block. 166 is a music data memory with the capacity to store the binary coded music data of a least one entire piece of music. 167 is a comparator which converts time data relating to various items of music data such as notes and spaces into numeric data and then compares the resulting values with the count value in the counter 164. 168 is an interface sequencer with a parallel-serial conversion function which is used for the serial processing of data output from the main microprocessor 165. 169 is a sound source which is driven by data received in serial format and which modulates the sampling or FM waveform in order to generate an analog signal. The counter 164 and comparator 167 can be configured as separate circuits from the main microprocessor 165 or, where the main microprocessor has substantial processing capacity, they can equally be configured as internal microprocessor circuits.

Figure 17:
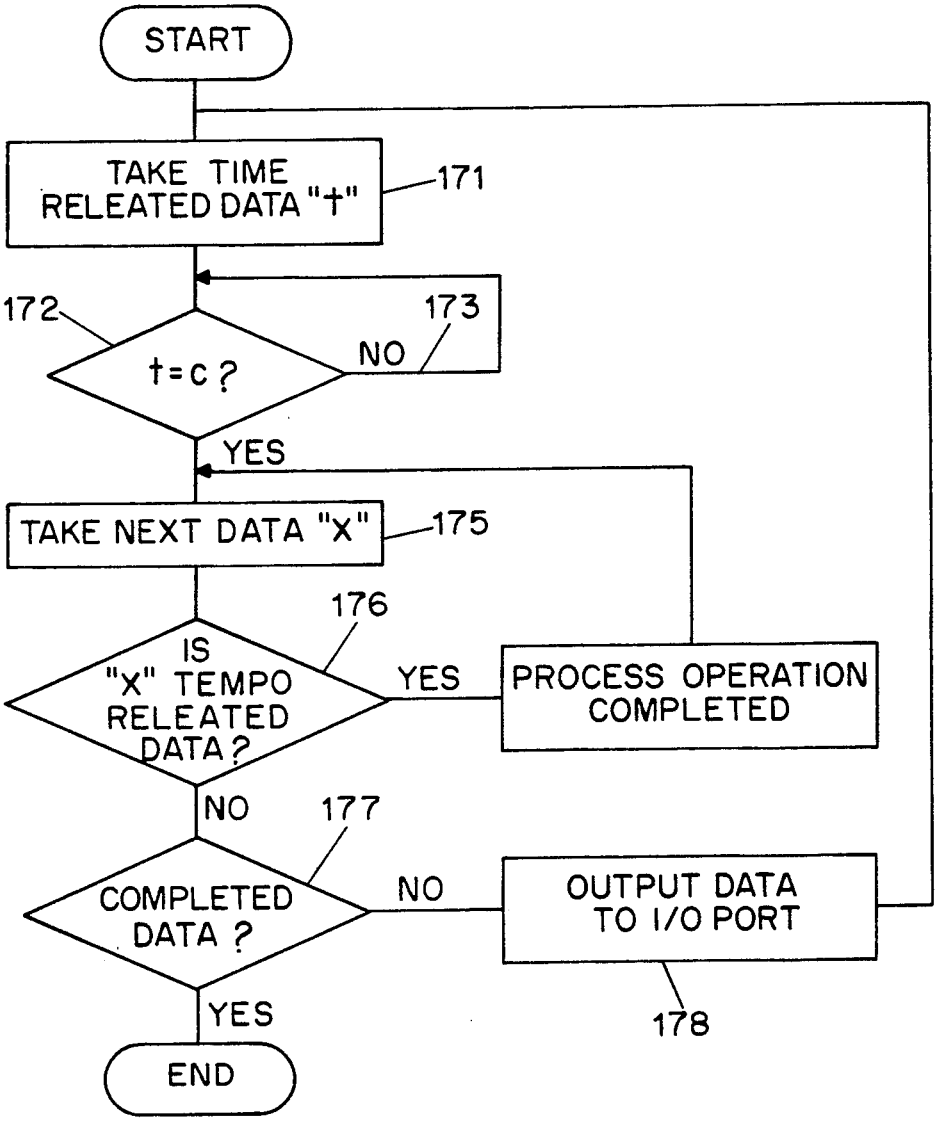
FIG. 17 is a flowchart of the drive procedure of the mechanism in FIG. 16.

FIG. 17 is a flowchart illustrating the operating procedure of the mechanism in FIG. 16 insofar as it relates to time and tempo related data contained in a block of music data. Time related data uses numeric values from 0 to 192 to indicate the duration of a specified note. In a musical score, for example, this same feature may be indicated in terms of the length of time for which a note is to be held after a bar line or similarly how long a stop should be held. Tempo related data also, of course, uses numeric values to indicate the required reproduction tempo in terms of speed per minute. The data is mixed at the point where the music data processing operation starts and again at each point where the tempo changes. When the processing of the music data is started in FIG. 17, first the tempo is determined. Next the division value of the divider 162 is specified in accordance with the said tempo value and an appropriate time interval between the trigger signals output by the 16-bit timer 163 is determined. The process now starts at this speed with units of data being taken one by one from the stream of music data bits and processed. When the data taken from the data stream is time related data (171), then the comparator 167 compares the specified time value "t" with the current count value "C" (172) and if count value "C" has not yet reached the time value indicated by "t", then the operation is continued until the values match (173). When the bits match (174), then the next step is to take the next unit of data "x" from the music data bit stream (175). Data unit "x" is then checked to determine whether or not it is tempo related data (176). If it is not tempo related data then it is checked to determine whether or not it is data for which processing can be completed at the next step (177) and if so then the processing operation is completed. If it is not data for which the processing can be completed at the next step but is, in fact, determined to be sound related data, then it is output as data from the sequencer 168 (178) which subsequently generates an audio signal from the sound source. If, on the other hand, it is determined that data "x" from the block (176) is tempo related data, then the main microprocessor 165 issues a tempo modification command and a modified speed value to the divider 162 which responds by modifying the trigger signal output cycle from the 16-bit timer 163. Since this operation involves the modification of the speed of the count value itself, which constitutes the basis for all the time processing operations, this means that the modification which has been carried out will ultimately affect only the tempo of the music while leaving the overall balance of the music data processing operations unchanged. Tempo indications need, of course, to be as faithful to the original as possible in order to capture the full flavor of the variations such as "ritardando", for example, that are incorporated into the sheet music. However, the placing of excessive emphasis on this point can result in overloading the program with tempo related data. If account is also taken of the limited number of tempo variations which can, in reality, be accommodated by the average amateur vocalist, then this will result in the selection of a more appropriate number from the outset. For safety, the corresponding division values can also be compared in advance by means of tables where so required. It is possible, in this way, to avoid overloading a program with tempo related data.

Figure 18:
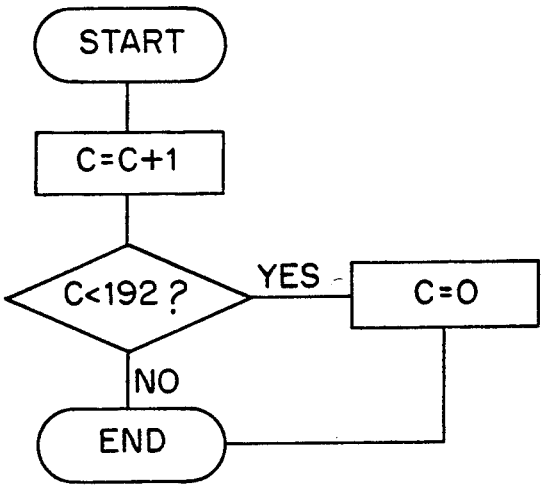
FIG. 18 is a flowchart of the adding operation of the counter in FIG. 16.

FIG. 18 illustrates the procedure followed by the counter 164 in computing count value "C". In the illustrated case the maximum count value "C" matches the maximum time value "t". When the counter 164 has counted to the maximum value of 192, then it will start to count again from 0 on the next step.

What is claimed is:

1. A karaoke music reproduction device for the reproduction of music and lyrics, said karaoke device comprising:

a memory device for storing a number of pieces of music in the form of binary coded music data;

an input device for selecting specified music data from said memory device;

a first microprocessor for reading out said specified music data from said memory device;

a second microprocessor for converting the music data read out by said first microprocessor to signal data conforming to a specified standard;

first and second memory areas connected to said first and second microprocessors for transferring said music data from said first microprocessor to said second microprocessor, wherein each said memory area is used alternately for reading and writing operations;

a sequencer connected to said second microprocessor for outputting said signal data; and a sound source connected to said sequencer for receiving said output signal data.

2. The karaoke music reproduction device according to claim 1 wherein each memory device is a magneto-optical disc.

3. The karaoke music reproduction device according to claim 1 wherein the specified standard is the MIDI standard.

4. A karaoke music reproduction device comprising:

means including an input device for downloading, via a public communications line, specified music data selected from the database of a host computer consisting of a number of pieces of music stored in the form of binary coded music data, dividing said downloaded specified music data into data units and loading said units alternately into each of two memory areas;

first microprocessor means for outputting a fixed length signal upon completion of the loading of each of said data units; and second microprocessor means operative in response to receipt of said fixed length signal to save each said data unit alternately from said memory area into a separate memory device.

5. The karaoke music reproduction device according to claim 4 wherein each memory device is a magneto-optical disc.

6. A karaoke music reproduction device connected via a public communications line to a host computer comprising:

sequencer means for sequentially processing music data; and sound source means coupled to said sequencer means and including a buffer in which to accept, in stages, processed data outputted by said sequencer wherein said sound source uses the processed data to generate an audio signal which is then output to peripheral units and wherein said sound source carries out interrupt processing by loading the processed data in response to a strobe pulse output from said sequencer if there is sufficient space in the buffer and outputting a pulse signal to said sequencer if there is insufficient space in said buffer.

7. the karaoke music reproduction device according to claim 6 wherein the sound source includes means for determining the readiness of peripheral units for reproduction, and outputting a pause signal to the sequencer in cases where peripheral units are not read for reproduction.

8. A karaoke music reproduction device according to claim 6, wherein each peripheral unit is an amplifier.

9. A karaoke music reproduction device configured for time processing, via a microprocessor, of binary coded music data including the duration of musical notes, the length of time between musical notes and the specification of the tempo of a piece of music, then converting the processed data from parallel to serial format by using a sequencer and then outputting the converted data to a sound source, said configuration comprising:

a divider for generating in accordance with a clock specified division values which can be modified in response to a signal from the microprocessor whenever said music data corresponds to tempo;

a timer coupled to said divider for generating and applying to said microprocessor trigger signals of specified length in accordance with the division values generated by the divider;

a counter coupled to said timer for counting a fixed number of cycles in accordance with the trigger signals; and a comparator coupled to said microprocessor for comparing the count value of the counter with music data as it relates to the duration of time of a musical note or the length of time between musical notes and then taking a next unit of music data when the time-related music data corresponds to the count value.

10. The karaoke music reproduction device according to claim 9 wherein the timer is a 16-bit timer.

* * * * *